US008869731B2

(12) United States Patent
Dow et al.

(10) Patent No.: US 8,869,731 B2
(45) Date of Patent: Oct. 28, 2014

(54) ADJUSTABLE KAYAK CHAIR

(71) Applicant: Hobie Cat Company, Oceanside, CA (US)

(72) Inventors: Philip James Dow, Oceanside, CA (US); James Taylor Czarnowski, Fallbrook, CA (US); Jason Christopher Kardas, Vista, CA (US); Gregory Scott Ketterman, Oceanside, CA (US)

(73) Assignee: Hobie Cat Company, Oceanside, CA (US)

( * ) Notice: Subject to any disclaimer, the term of this patent is extended or adjusted under 35 U.S.C. 154(b) by 110 days.

(21) Appl. No.: 13/779,328

(22) Filed: Feb. 27, 2013

(65) Prior Publication Data

US 2013/0239873 A1 Sep. 19, 2013

Related U.S. Application Data

(60) Provisional application No. 61/612,143, filed on Mar. 16, 2012, provisional application No. 61/721,970, filed on Nov. 2, 2012.

(51) Int. Cl.
*B63B 29/04* (2006.01)

(52) U.S. Cl.
CPC ..... *B63B 29/04* (2013.01)
USPC ..... 114/363; 114/347

(58) Field of Classification Search
USPC ..... 114/347, 363; 297/311, 317, 344.1, 297/463.1, 320, 338
See application file for complete search history.

(56) References Cited

U.S. PATENT DOCUMENTS

| | | | | |
|---|---|---|---|---|
| 53,415 | A | 3/1866 | Cole | |
| 2,644,177 | A | 7/1953 | Stanley | |
| 4,768,454 | A | 9/1988 | Selken | |
| 5,513,900 | A | 5/1996 | Iglesias | |
| 5,622,403 | A | 4/1997 | Gonda | |
| 5,651,706 | A | 7/1997 | Kasper | |
| 6,065,422 | A | 5/2000 | Davidson et al. | |
| 6,311,632 | B1 | 11/2001 | Noel, Jr. | |
| 6,736,084 | B2 * | 5/2004 | McDonough et al. | 114/363 |
| 6,827,396 | B1 | 12/2004 | Jewell | |
| 6,925,955 | B1 | 8/2005 | Brooks | |
| 8,387,940 | B2 | 3/2013 | Gros | |
| 8,651,576 | B2 * | 2/2014 | Farber | 114/363 |
| 2006/0202533 | A1 | 9/2006 | Goodman | |
| 2008/0060569 | A1 | 3/2008 | Howard | |
| 2008/0283105 | A1 | 11/2008 | DuBose, III | |
| 2009/0038526 | A1 | 2/2009 | Walton | |
| 2009/0038529 | A1 | 2/2009 | Walton | |
| 2012/0017821 | A1 | 1/2012 | Mcdonough | |

FOREIGN PATENT DOCUMENTS

| | | | |
|---|---|---|---|
| GB | 2270283 | A | 3/1994 |
| JP | 2008094168 | A | 4/2008 |

* cited by examiner

*Primary Examiner* — Lars A Olson
(74) *Attorney, Agent, or Firm* — Joseph E. Mueth, Esq.

(57) ABSTRACT

A watercraft having a chair with seat securely carried on the watercraft, the chair having a tubular frame comprising a seat frame, a back frame, and arms above and at each side of the seat frame. The seat and back frames are joined via a hinged connection. The front support legs extend downwardly from the front of each of the arms and terminate in a foot-like projection. A U-shaped rear chair support having downwardly extending portions at the rear of each of the arms, which are joined at their lower extremity by a horizontal portion. The surface of the watercraft has adhered thereto two spaced apart shoes for receiving the feet.

6 Claims, 23 Drawing Sheets

ADJUSTABLE KAYAK CHAIR

This application claims the benefit of U.S. Provisional Patent Application Ser. No. 61/612,143 filed Mar. 16, 2012 and U.S. Provisional Patent Application Ser. No. 61/721,970 filed Nov. 2, 2012, the disclosures of which are incorporated herein by reference.

BACKGROUND OF THE INVENTION

Various seating arrangements are known to be used on kayaks and other small pleasure craft. It is desirable that the seat be both comfortable and secured to the watercraft. This invention provides a novel chair which is adapted to be firmly secured to a watercraft while also being adjustable in multiple ways to suit a variety of preferences.

SUMMARY OF INVENTION

Briefly, the present invention comprises a watercraft having a chair with seat securely carried on said watercraft;

said chair having a tubular frame and comprising a seat frame, a back frame, said seat and back frames being joined via a hinged connection, arms above and at each side of the seat frame, front support legs extending downwardly from the front of each of the arms, a U-shaped rear chair support having downwardly extending portions at the rear of each of said arms, said portions joined at their lower extremity by a horizontal portion, the frames of both said seat and said back having material extending across the frame to provide a supported seating area and back support area, the lower extremity of each of the front support legs having a foot-like forward projection terminating in a toe, the surface of said watercraft having secured thereto two spaced apart shoes for receiving said feet, the shoes and feet being shaped such that the toe of the feet can be inserted into and removed from the shoes only when the rear of the chair is rotated upwardly and forwardly about said shoes, said feet and shoes being locked together when the chair is rotated downwardly and rearwardly.

More particularly, the invention comprises a kayak or other recreational boat having a chair securely carried on a surface of said kayak or other recreational watercraft;

said chair having a tubular frame and comprising a seat frame, a back frame, said seat and back frames being joined via a hinged connection, arms above and at each side of the seat frame, front support legs extending downwardly from the front of each of the arms, a U-shaped rear chair a support having downwardly extending portions at the rear of each of said arms, said portions joined at their lower extremity by a horizontal portion, the frames of both said seat and said back having waterproof fabric or cloth stretched tautly across the frame to provide a supported seating area and back support area, the lower extremity of each of the front support legs having a foot-like forward projection terminating in a toe, the surface of said watercraft having joined thereto two spaced apart shoes for receiving said feet, the shoes and feet being shaped such that the toe of the feet can be inserted into and removed from the shoes only when the rear of the chair is rotated upwardly and forwardly about said shoes, said feet and shoes being locked together when the chair is rotated downwardly and rearwardly, securing the chair to the watercraft.

In another feature of the invention, the horizontal portion at the rear of the chair interacts with a mechanism attached to the deck of the watercraft which serves as a kick stand as further described. This mechanism or kick stand props up the back of the seat frame allowing for the chair to be supported at its rear in a raised or high position. The kick stand is joined to the cockpit or deck of the watercraft at each of its ends, attaches to the horizontal portion at the rear of the chair with a central flexible webbing having a grommet which locks onto a post on the horizontal portion at the rear of the chair.

This webbing serves several purposes. It limits the motion of the seat assembly to keep the feet attached to the kayak shoes. It also keeps the kick stand assembly retracted away from the seat when in the low position. To move the seat into the up position from the low position, the user must shift his weight forward in the seat and lift up slightly on the back of the arm rests, rotating the back of the seat assembly away from the kayak, and activating the kick stand mechanism. When the back of the seat frame is rotated away from the watercraft, the kick stand mechanism rotates into an over-center position, holding the seat assembly in the high position. To return to the low position from the high position, the user must again shift his weight forward and lift up slightly higher on the back of the arm rests to clear the kick stand. Once the seat frame clears the kick stand, the kick stand mechanism rotates back down to a retracted position and the seat is free to rotate back to the low position.

In yet another feature, both the seat back and seat bottom can be adjusted to suit the user with a unique rotating adjuster that has been designed into each of the arm rests of the seat. The one side arm rest adjuster operates the seat back, and the right side armrest adjuster operates the seat bottom. To bring the seat back forwards, the user shifts his weight off of the seat back and rotates the top of the adjuster handle away from the his body. The adjuster handle has teeth at one end which engage the top and bottom of a metal pin that is assembled through the aluminum tube section of the arm rest. This feature combined with a spring pushing the teeth and the pin together holds the adjuster handle in a locked position. When the top of the handle is rotated away from the user, the ramp on the back side of the teeth allows the handle to turn and engage the next set of teeth. To recline the seat back, the user must again shift his weight away from the seat back, and then push the handle forwards along the tube of the arm rest. This disengages the teeth, allowing the top of the handle to be rotated towards the user, reclining the seat back. The seat bottom is adjusted in the same fashion.

In still an additional feature, the seat back is provided with a lumbar adjustment which spans the back frame, side-to-side to adjust the tension in the fabric of the seat back.

This seat of this invention meets the needs of recreational and fishing kayakers in significant respects. The seat is comprised of an aluminum tube frame connected through a pivot to a seat back and seat bottom tube frame. The seating material is fixed to these tubes to allow for comfortable distribution of the user's weight on the seat. This seating material is designed to allow air to pass through, and not to hold water which helps to keep the user dry and cool. There is also a three dimensional mesh integrated into the seating material to increase the airflow and decrease the pressure points.

The seat back and seat bottom can be adjusted easily using integrated mechanical adjuster handles which adjust the lines supporting the seat back and bottom. The seat can be used in one of two discrete height positions; up or down. The up position allows for a better line of sight into the water for fishing or nature watching. The lower position offers a lower center of gravity and therefore more stability in the small boat. The front of the seat assembly is attached to the watercraft via a foot and shoe design that allows the seat assembly to rotate while remaining fixed to the watercraft. This pivoting action along with a rear kick stand arrangement allow for the up and down seating functionality. This foot and shoe design also allows for very quick attachment and removal of the seat to the watercraft. The seat bottom can be lifted and rotated up towards the seat back to allow the user to stand where they were seated. This allows the user to stand in the most stable position. Out of the watercraft, the seat can be used as a fully functioning chair.

THE DRAWINGS

FIG. 11 is a side view showing the kick stand retracted and the chair is down.

FIG. 12 shows the kick stand deployed and the chair carried in the raised position.

FIG. 13 shows how the taut web limits upward movement of the rear of the chair, thereby preventing disengagement of the feet from the shoes at the bottom of the front legs while at the same time causing the horizontal member to clear the tops of the chair support to commence downward movement of the rear chair.

FIG. 14 is a side view showing a man in the standing position with the seat raised and the chair in the up position on the kick stand.

DESCRIPTION OF PREFERRED EMBODIMENTS

Figure 1:
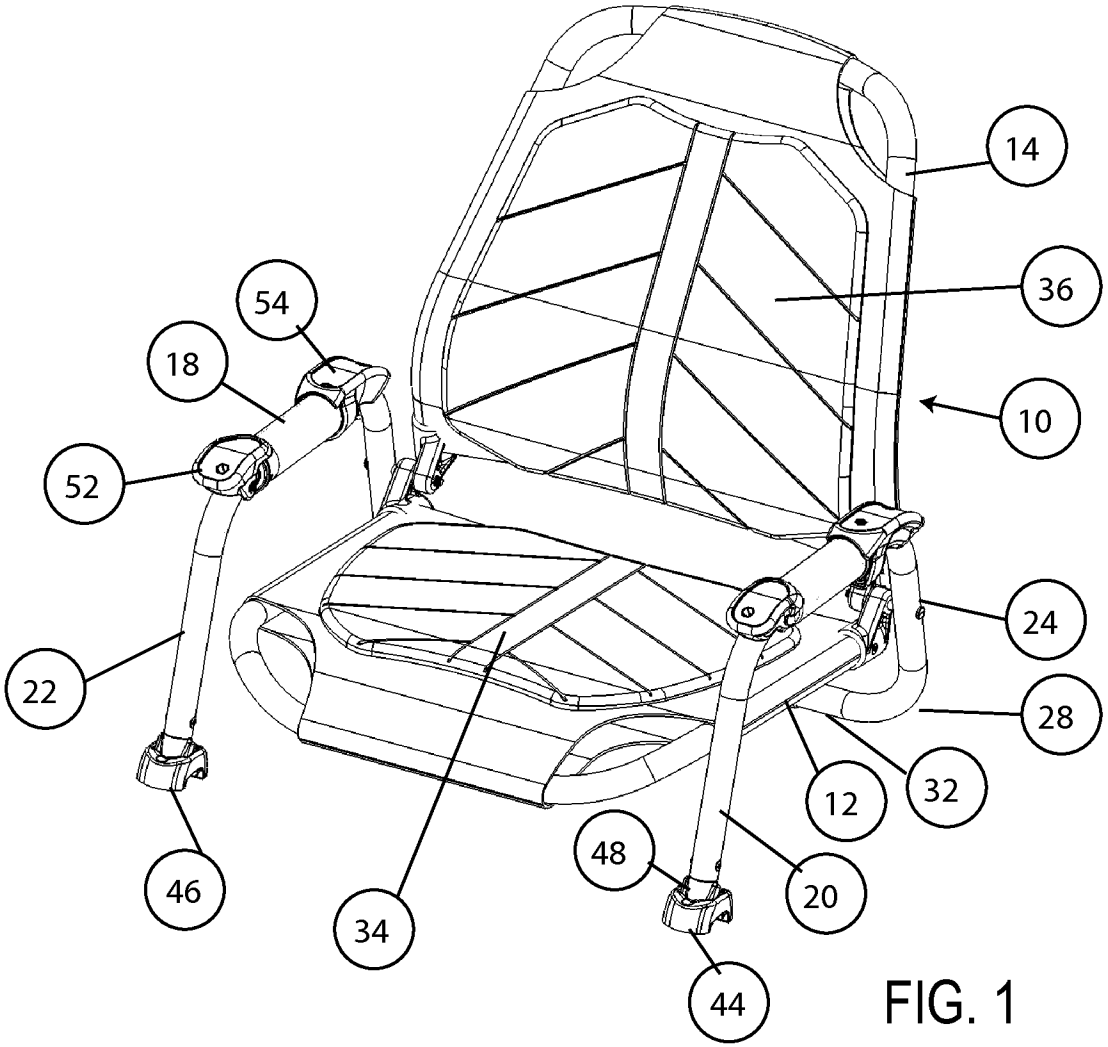
FIG. 1 is a perspective view taken from the upper left of the front of the chair of this invention.
Figure 2:
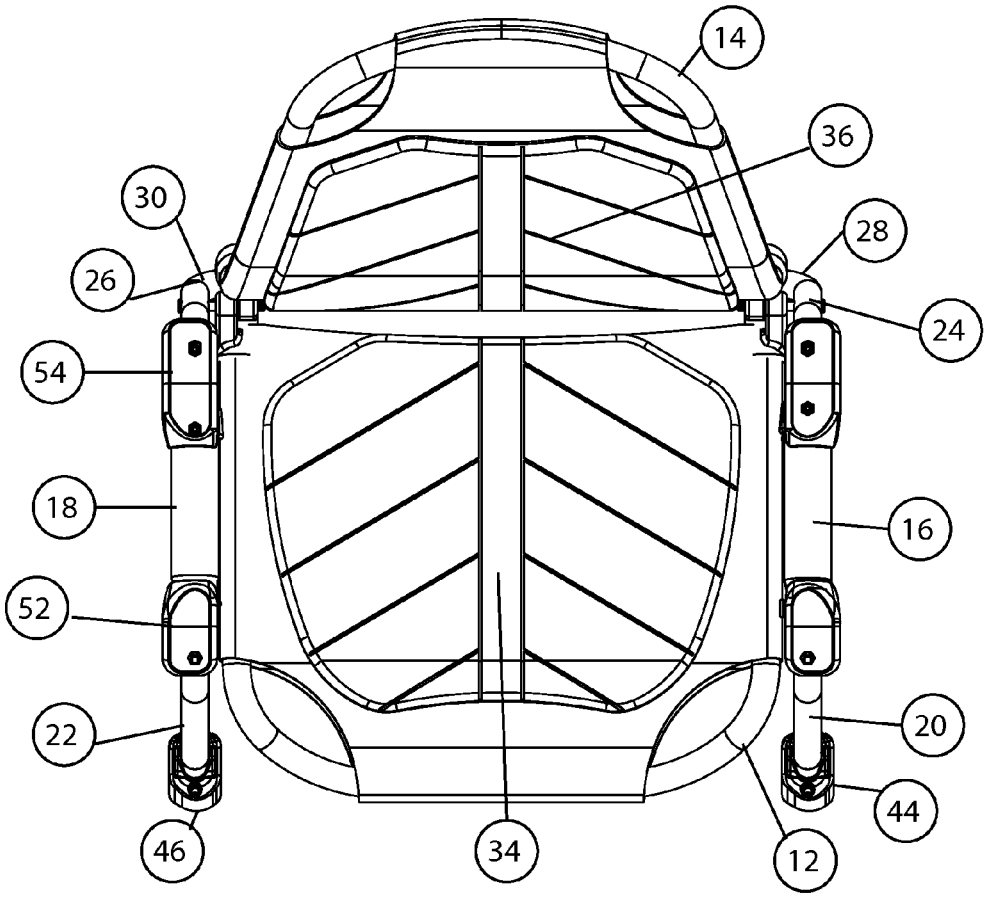
FIG. 2 is a top view of the chair of FIG. 1.
Figure 3:
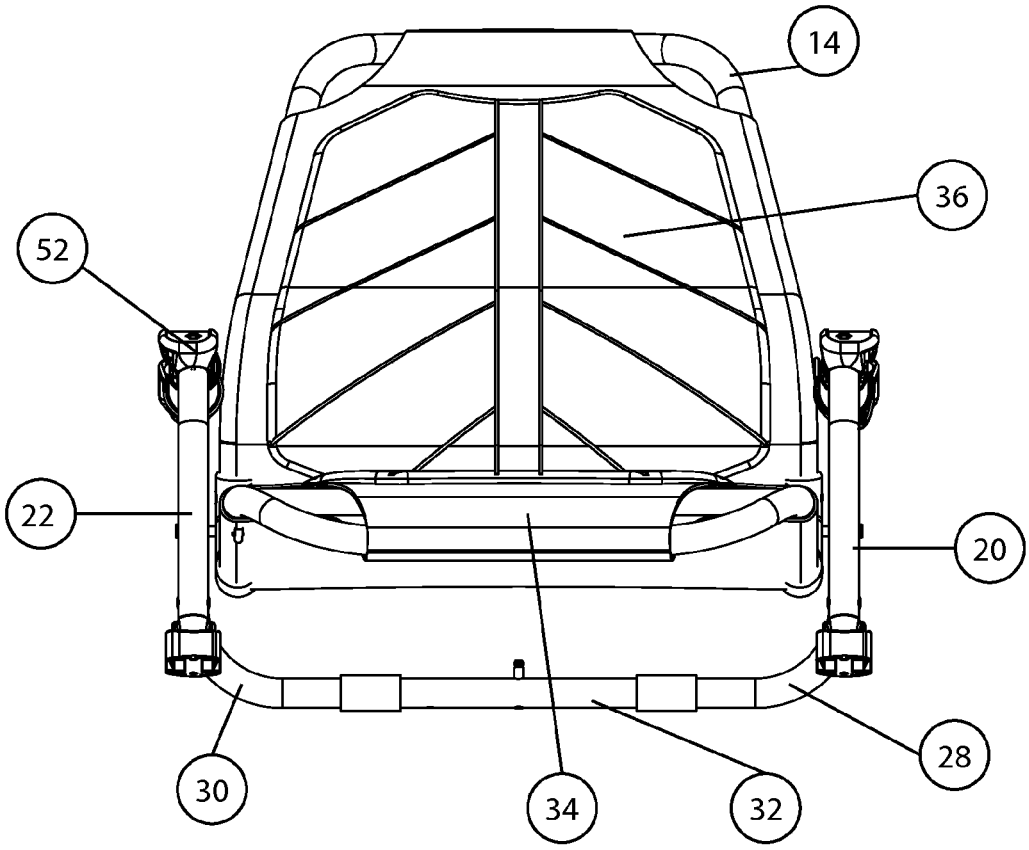
FIG. 3 is a front view of the chair of FIG. 1.
Figure 4:
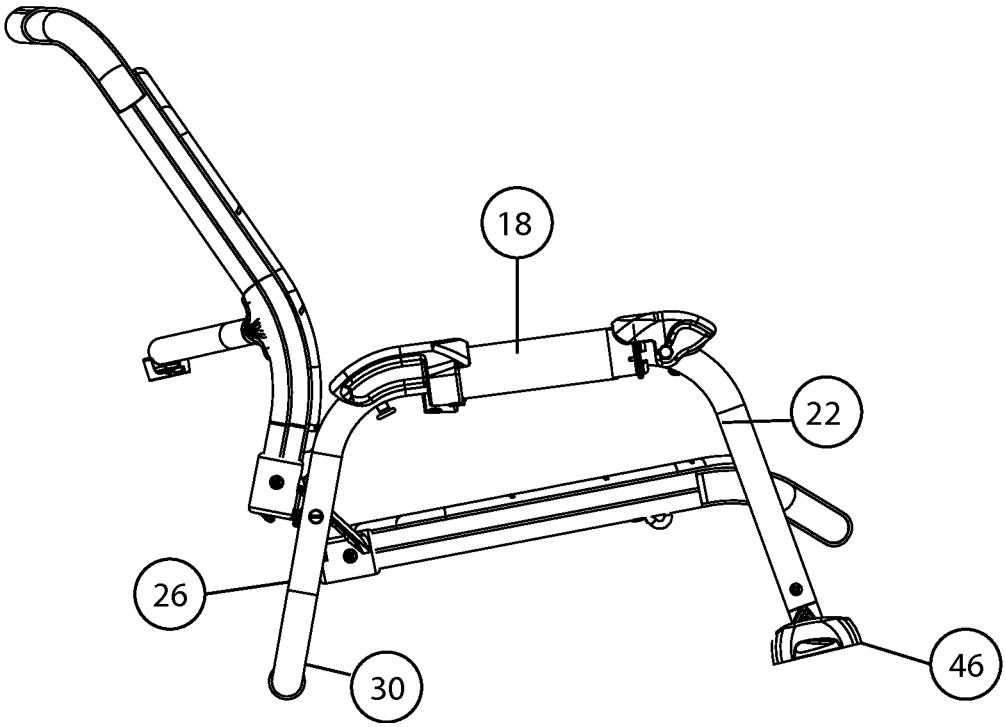
FIG. 4 is a side view of the chair of FIG. 1.
Figure 5:
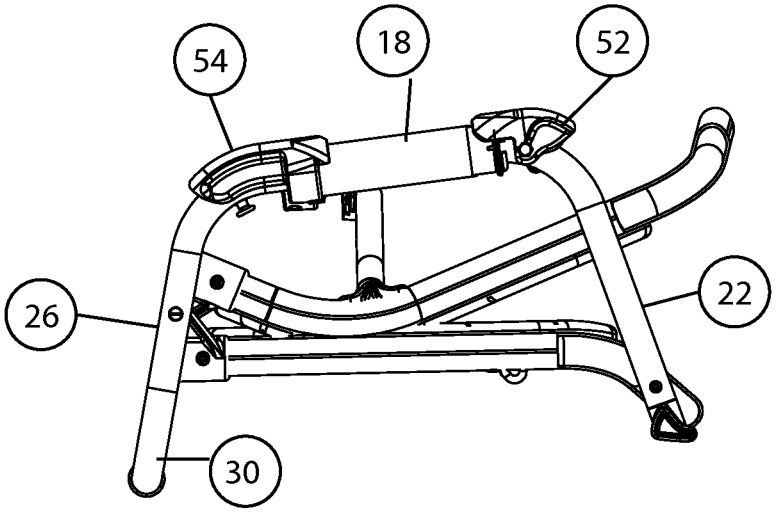
FIG. 5 is a side view of the chair of FIG. 1 with the back rotated forward.

Turning to the drawings in more detail, the chair 10 has a tubular metal seat frame 12, a tubular metal chair back frame 14, arm rests 16 and 18, and extending downwardly from the front of the arm rests front chair legs 20 and 22. At the rear of each of the arm rests is a downward tubular rear leg members, 24 and 26 which connects to curved tubular pieces 28 and 30. The rear chair support is the horizontal rear seat tube 32 connecting to curved pieces 28 and 30 to form a general U-shape.

The seat frame 12 and chair back frame 14 are pivotally connected to each other and rear leg members 24 and 26.

The seat frame 12 is provided with a waterproof fabric to create a seating area 34. Similarly, the back of the chair frame 14 is covered with fabric to form a back supporting area 36.

Figure 6C:
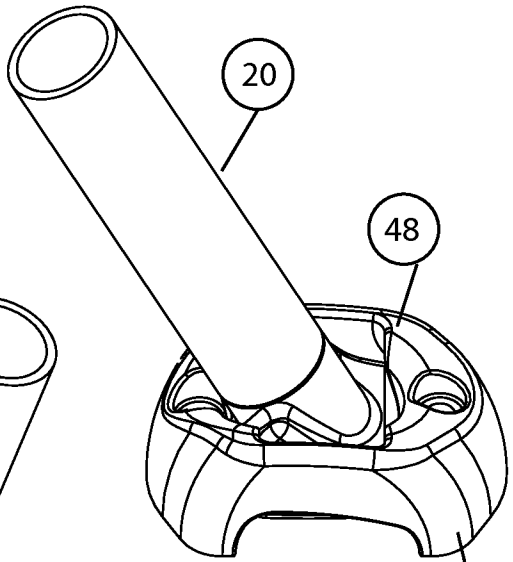
FIG. 6C shows the shoe with the leg and foot rotated to the rear to lock the two pieces together.
Figure 6B:
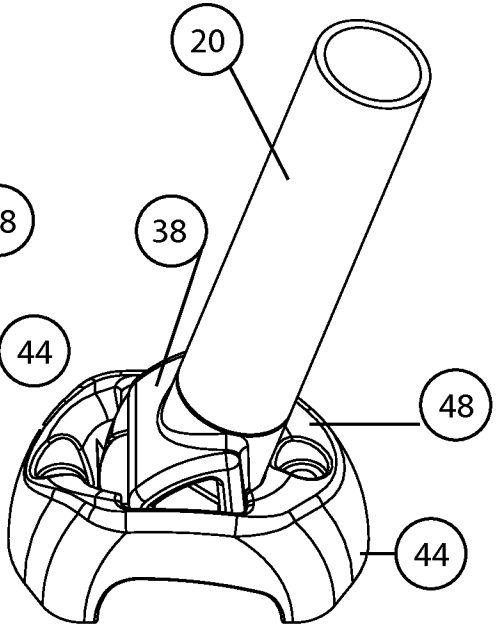
FIG. 6B shows the insertion of the foot into the shoe.
Figure 6A:
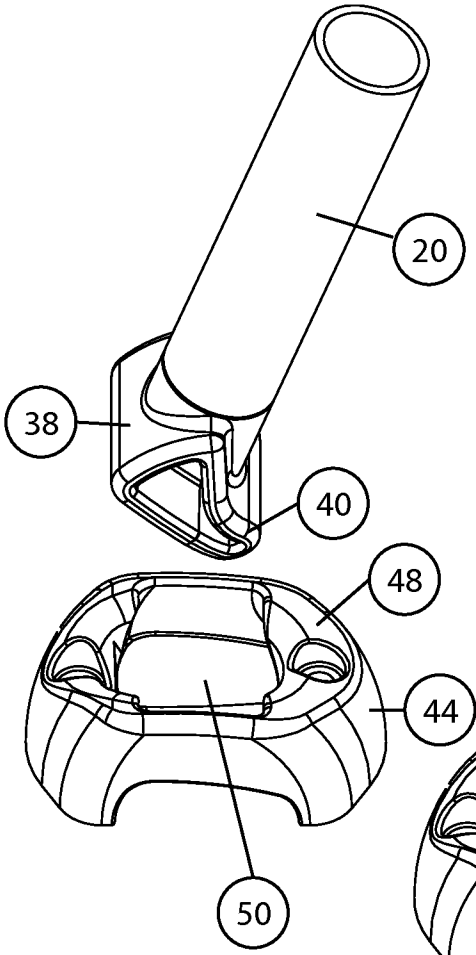
FIG. 6A shows the shoe attached to the kayak and one of the front legs to the chair with the foot attached at its lower extremity prior to insertion into the shoe.
Figure 7:
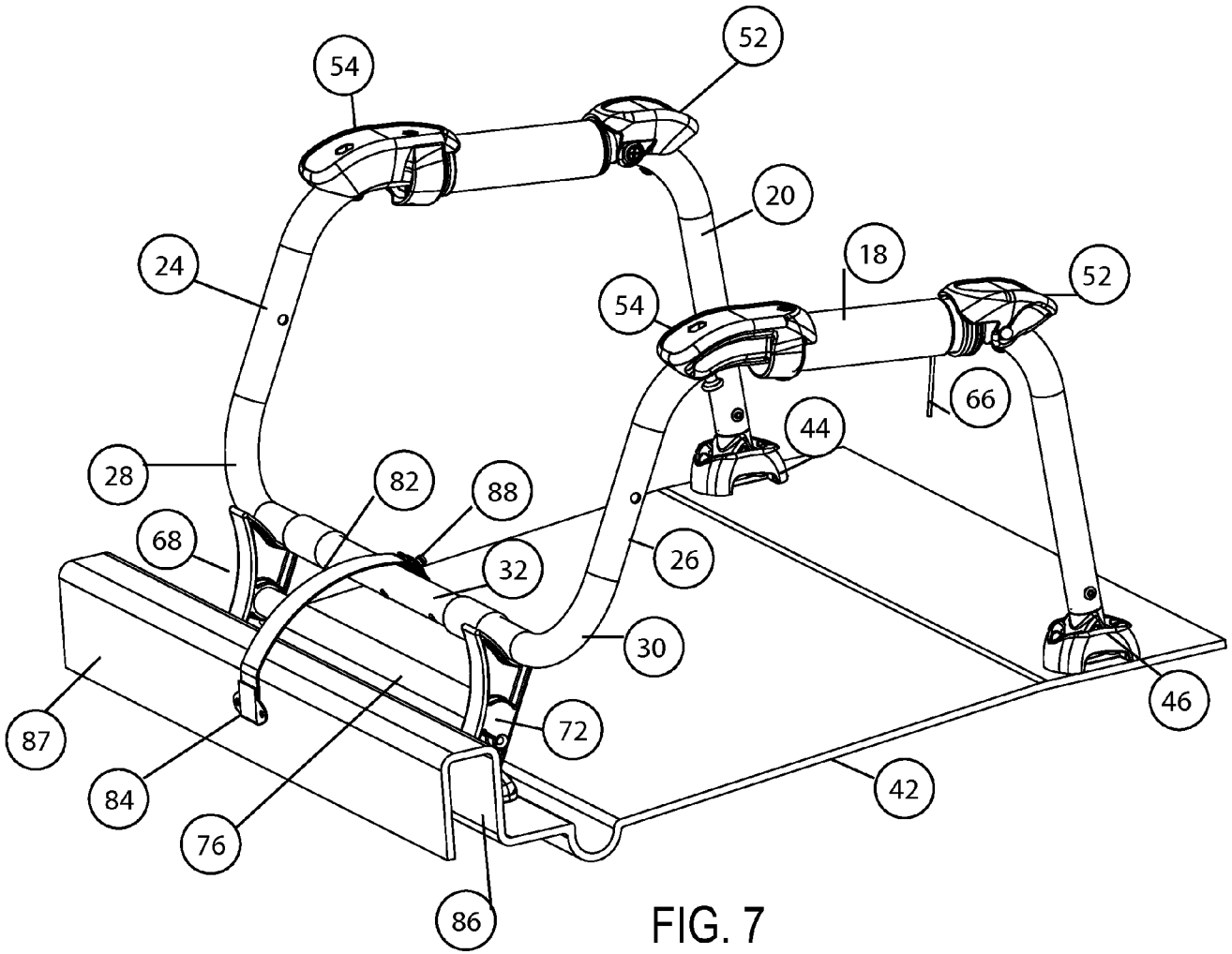
FIG. 7 is a right rear perspective view of the chair of FIG. 1, with seat and back removed, held by the shoe and foot arrangement at the front legs and shows the kick stand deployed and supporting the chair in the raised position.
Figure 8:
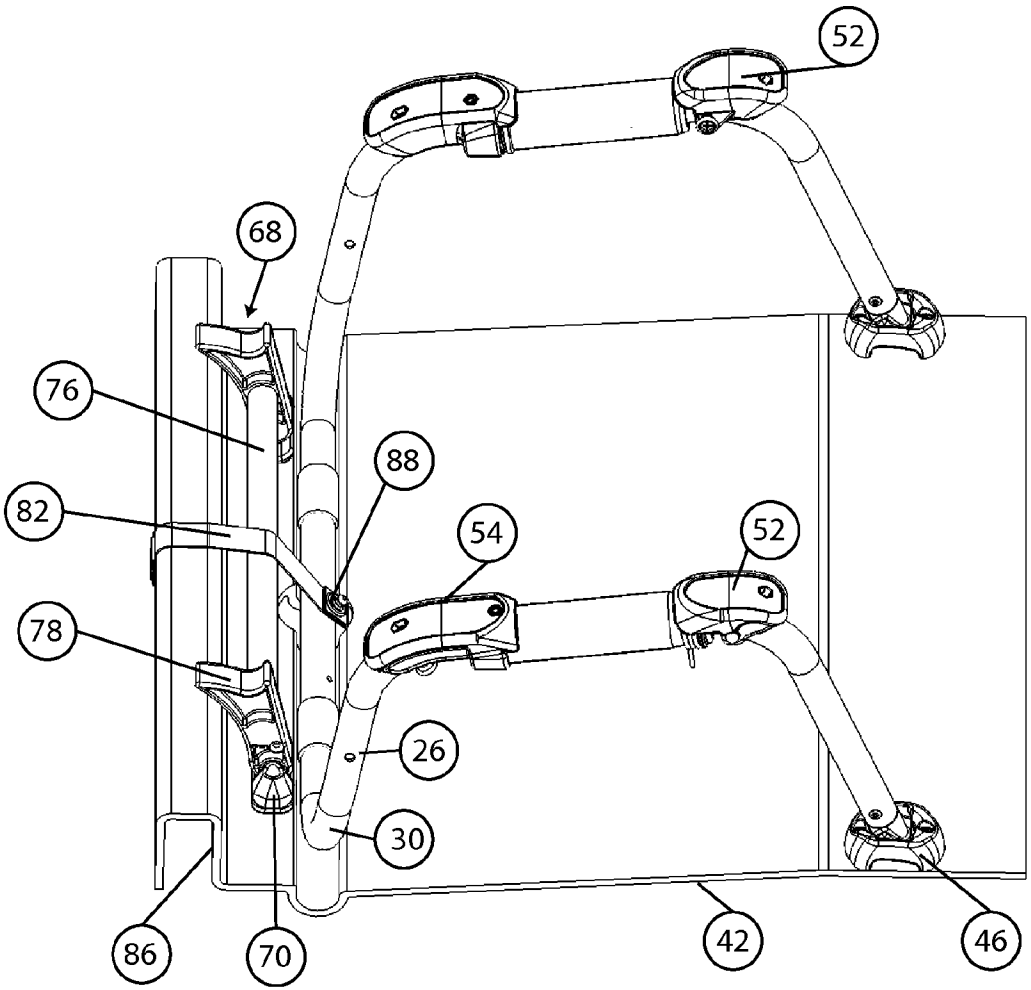
FIG. 8 is an upper side perspective view with the kick stand retracted and the chair frame in the down position.
Figure 9:
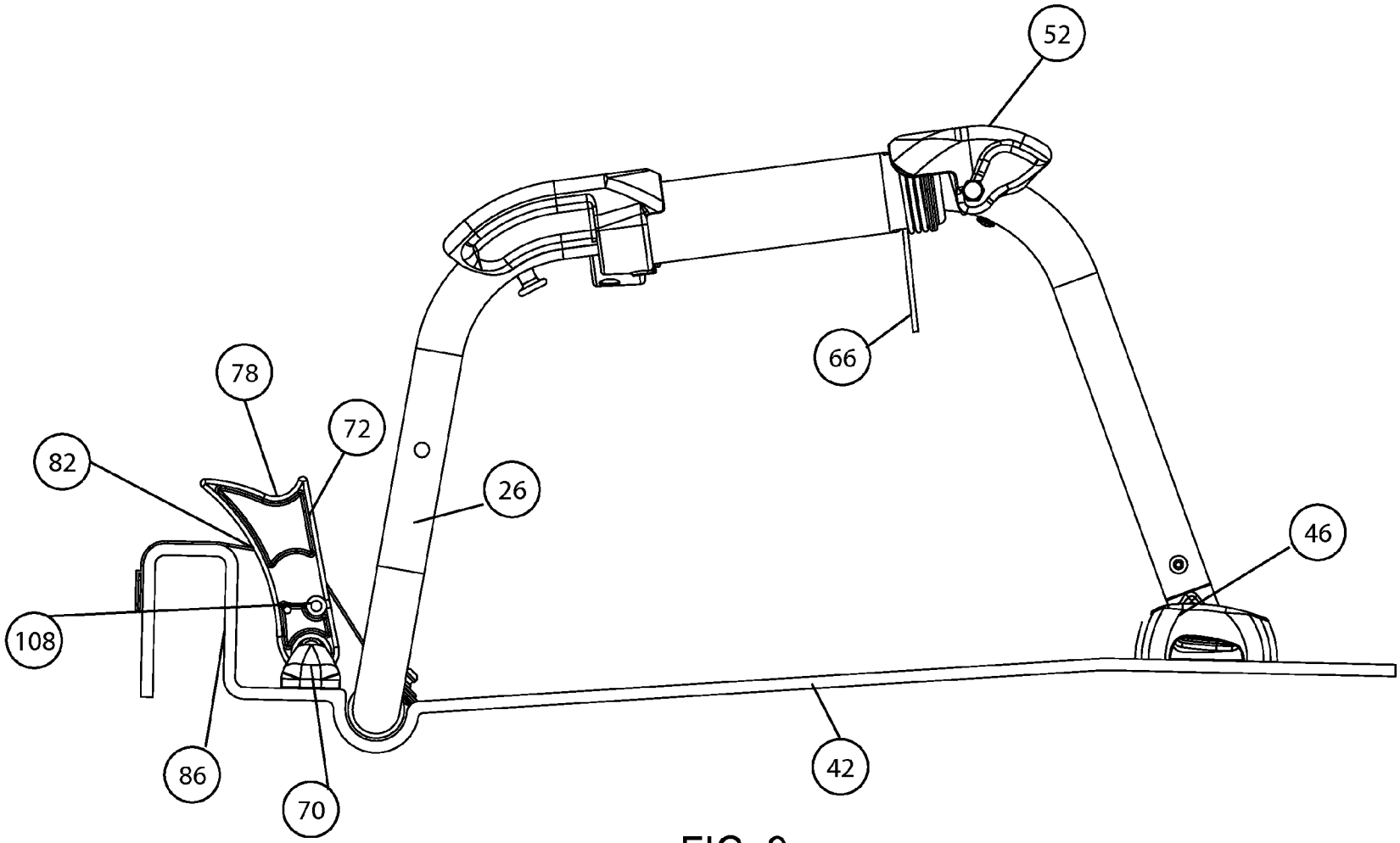
FIG. 9 is a side view of the retracted kick stand connected to the chair frame arrangement shown in FIG. 8.
Figure 10:
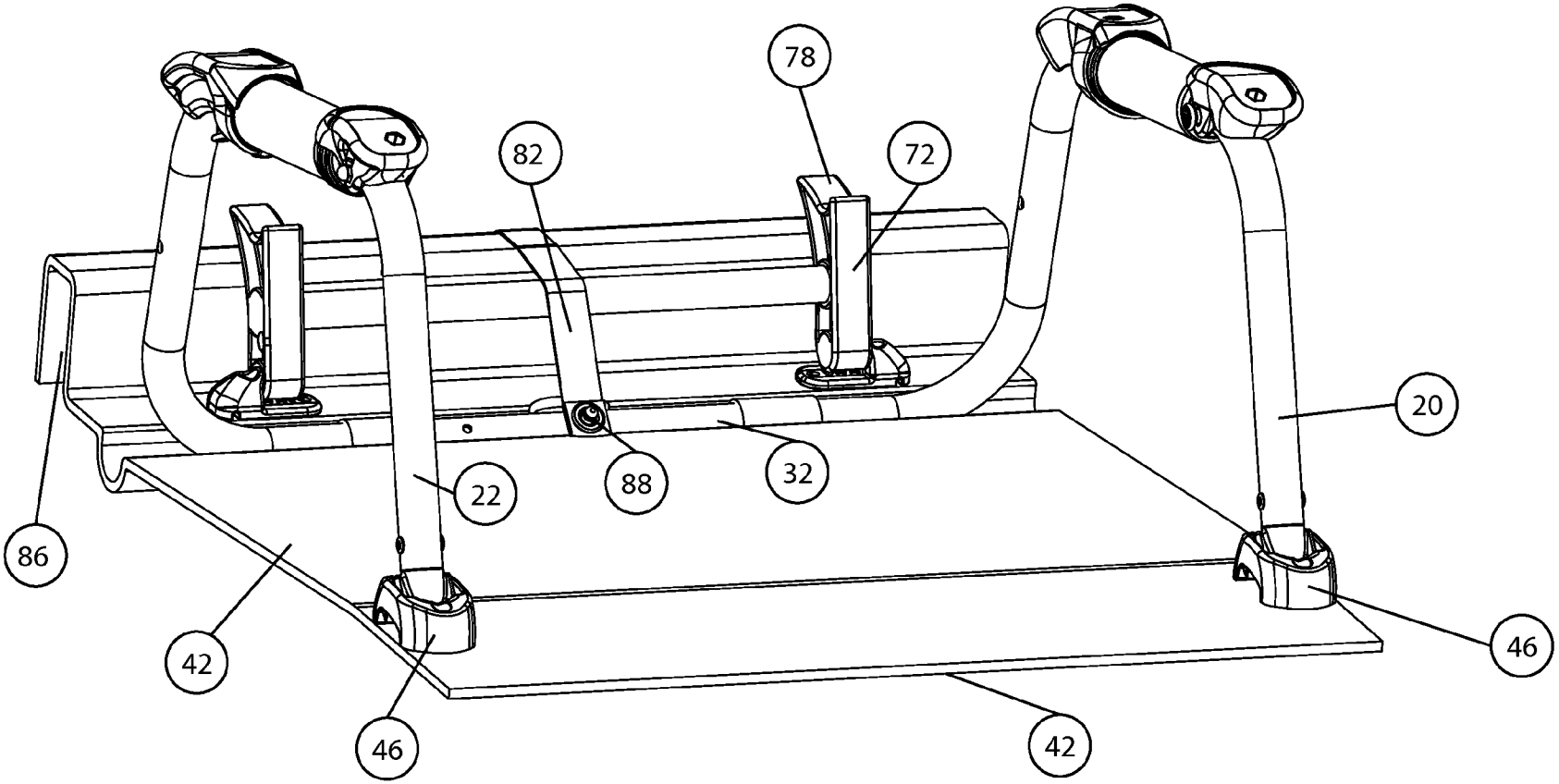
FIG. 10 is a right front perspective view of the chair frame and kick stand arrangement of FIG. 9.

As shown in FIGS. 6A to 6C, front chair legs 20, 22 each have a foot 38 at the lower extremity terminating in toe portion 40.

Joined to the surface of the cockpit or deck 42 are spaced apart shoes 44 and 46. Each shoe has a rigid front piece 48 partially covering the top of the shoe while leaving space beneath it for receiving the toe 40 of foot 38. To the rear of front piece 48 is opening 50 which allows for the insertion of the toe 40 under front piece 48 and upon rearward and downward rotation of chair leg 20 the balance of the foot 38 is received in opening 50 to lock the foot to the shoe as shown in FIG. 6C. To unlock the process is reversed with the leg 20 with foot 38 being rotated forward and then pulled upwardly out of the shoe 44.

In FIGS. 15A, 15B, 16A, 16B, 17, 18, 19 and 20 front and rear portions 52, 54 of the right armrest are removed or displaced to show the operation of the seat adjuster. At the rear of the tube 56 forming the center of armrest 18 are teeth 58 which engage the metal pin 60 held by and extending through the tubular section 62 carrying armrest 18. A coil spring 64 concentric in tube 56, is attached at one of its ends to the rear of the front portion 52 of the armrest. The coil spring 64 biases the teeth 58 and pin 60 together. The right arm adjuster operates the seat so that when the user pushes briefly forward and rotates tube 56 away from his body, the seat is raised as the line 66 at front of tube 56 is pulled up. The line 66 is attached to the seat at its lower end. When tube 56 is rotated away, the ramp 67 on the back side of teeth 58 allows the tube 56 to turn to engage the next set of teeth. This process can be repeated to select the seat height desired. By simply pushing forward on tube 56, the teeth 58 are disengaged, allowing the user to rotate tube 56 toward his body to return the seat to its original position.

The seat back is adjusted forwardly and operated from the left arm in the same way with the user shifting his weight away from the seat back while adjusting. The seat is returned to the original reclined position by turning the left arm tube toward the body of the user.

Figure 19:
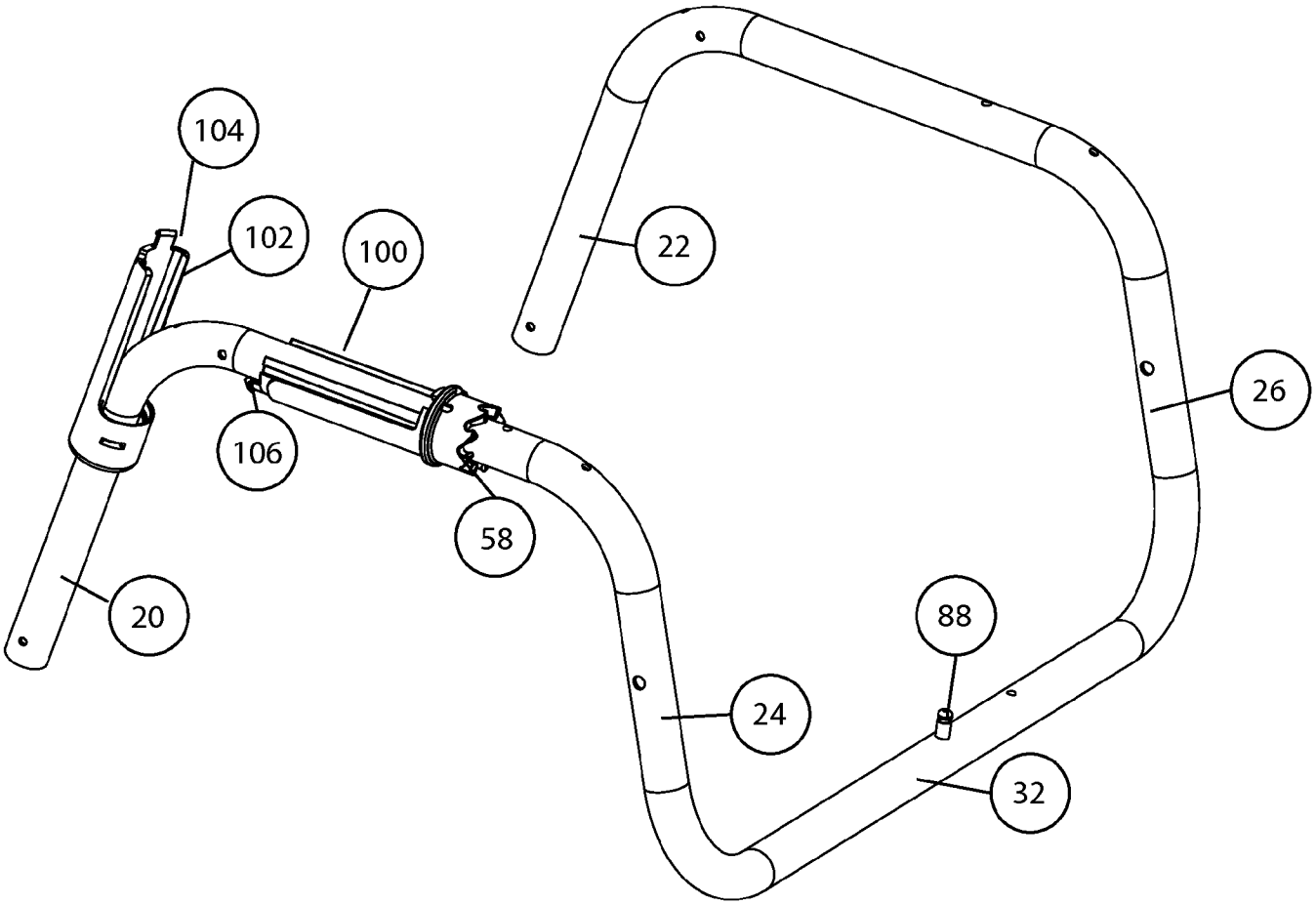
FIG. 19 is a side view of the adjuster handle components.
Figure 20:
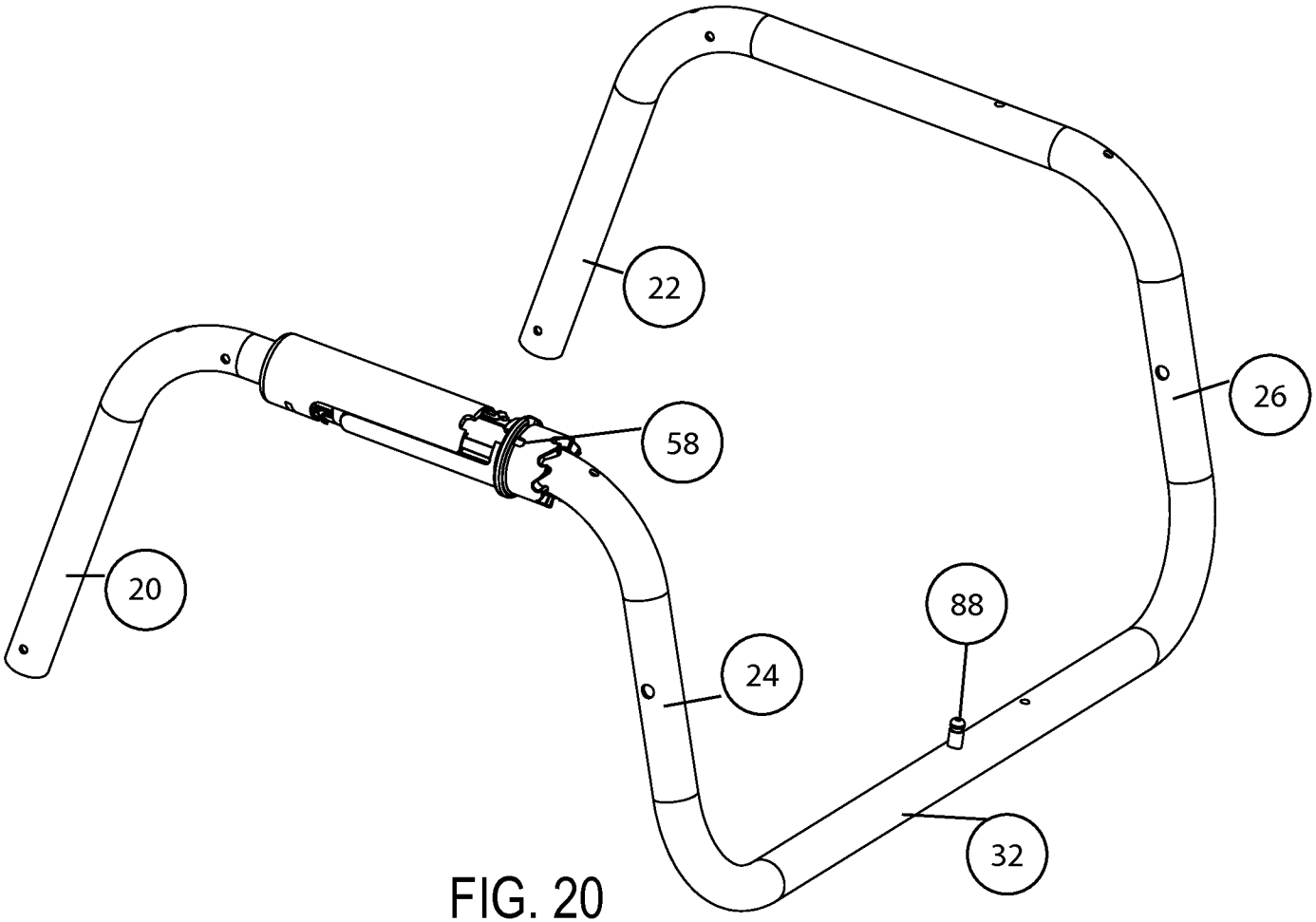
FIG. 20 is another side view of the adjuster handle components.

FIGS. 19 and 20 depict a preferred construction for the adjuster handle components to be assembled onto the main frame of the chair, and locked into each other. This is done to allow assembly of the adjuster onto the bent tube. The components have a tongue 100 and groove track 102 on each of the two mating surfaces that slide together, and two hooks 104 and 106 that positively lock the two pieces together once completely assembled. These adjuster handles take a torque load during use, so it is important that they have these features to allow them to be strong enough.

Turning to FIGS. 7 to 13 and 22, the kick stand, indicated generally as 68, is affixed to the deck 42. The retainer members 70 each carry uprights 72 by a pivotal connection. A kick stand tube 76 runs between uprights 72. The tube 76 is rotatably at end of its ends in uprights 72. The kick stand tube 76 includes at the top of uprights 72 u-shaped members 78 for receiving the horizontal tube 32 at the rear of chair 10 and serves to support the tube and the chair when the rear of the chair is in the "up" or raised position.

The web loop 82 also slidably passes through a retainer 84 on a vertical wall 87 at the rear of the kick stand. The web loop 82 is attachably and detachably connected by grommet 88 to the center of horizontal tube 32 of chair 10. The web loop 82 is of a length to allow upward movement of the horizontal member 32 of the chair to a limited extent as discussed below. By undoing the grommet 88, the chair 10 can be removed from the deck by pulling up and back to disengage the front feet from the shoes.

Figure 11:
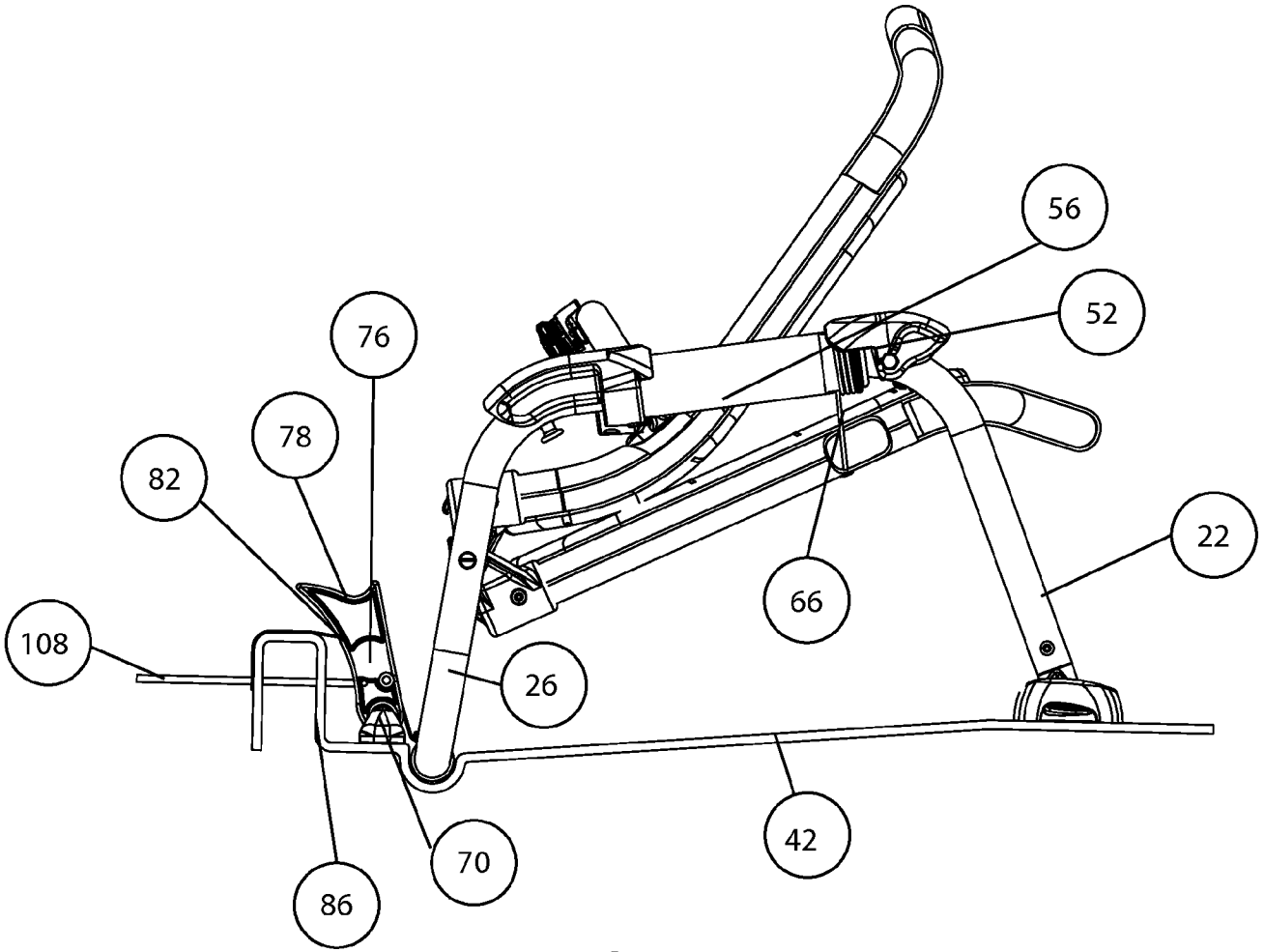
FIGS. 11 to 14 show the operation of the kick stand in a step sequence as the kick stand is raised and lowered to raise and lower the rear of the chair.

In the "standard" or "low" position of FIG. 11, the web loop 82 is wrapped taut over the front of the kick stand tube 76 keeping the kick stand assembly retracted against the wall 86 of the cockpit area 42 of the boat. Retracting the mechanism prevents it from protruding into the seating area. The bungee cord 80 is in a stretched position, readying the kick stand to move forward and engage the horizontal rear seat tube 32 once the back of the seat is lifted.

This arrangement allows the seat to be used in both a high and low position without compromising the strength of the structure. This pivoting design allows the seat to remain rigidly attached to the kayak in both the up and down position. It also allows the user to stay seated while adjusting the seat up and down. The front feet of the seat allows for this pivoting quick and effortless attachment and detachment of the seat from the kayak when grommet 88 is undone.

Figure 21:
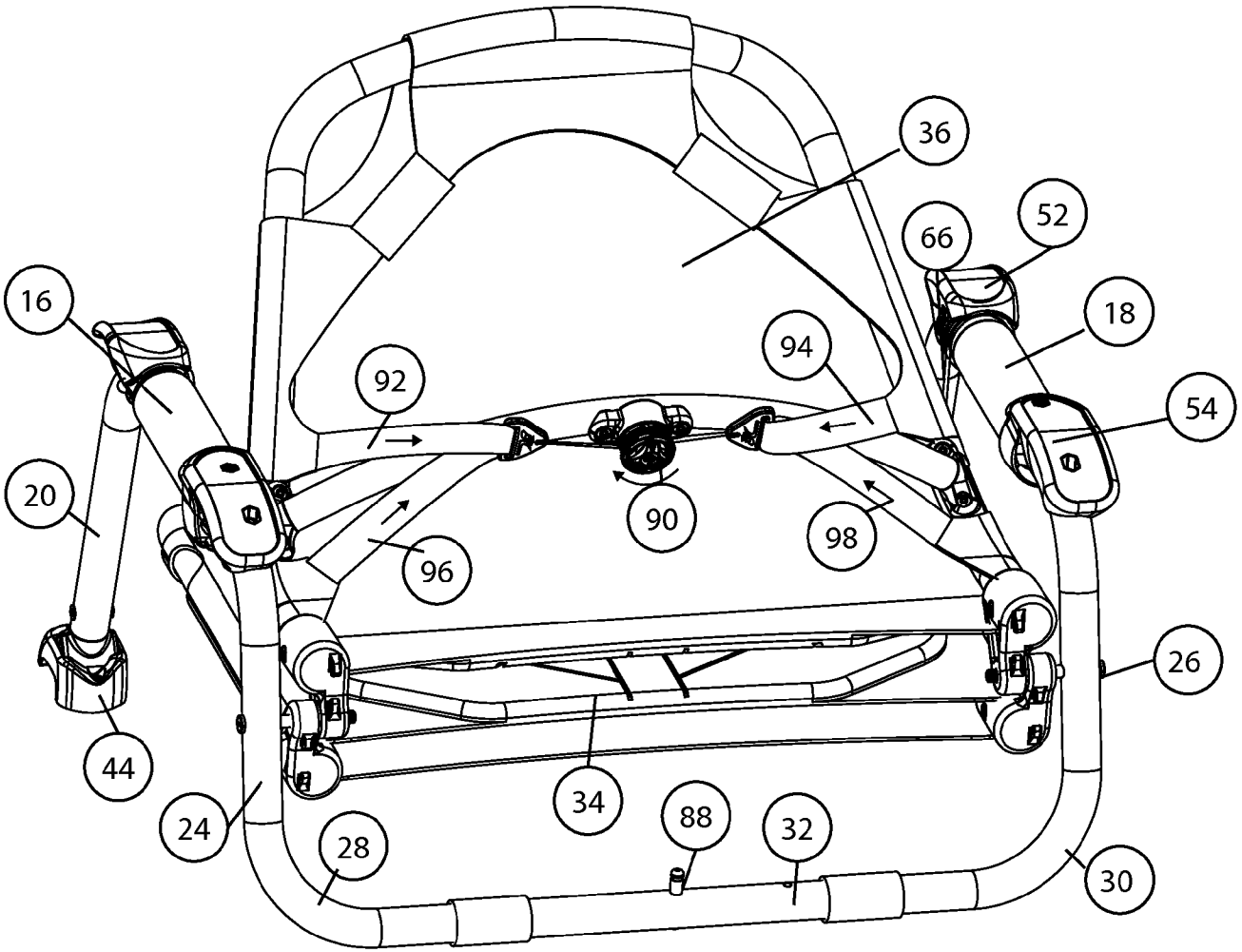
FIG. 21 is a rear view without kick stand, of the chair of FIG. 1 showing the lumbar support mechanism for adjusting the tension in the fabric of the seat back.
Figure 22:
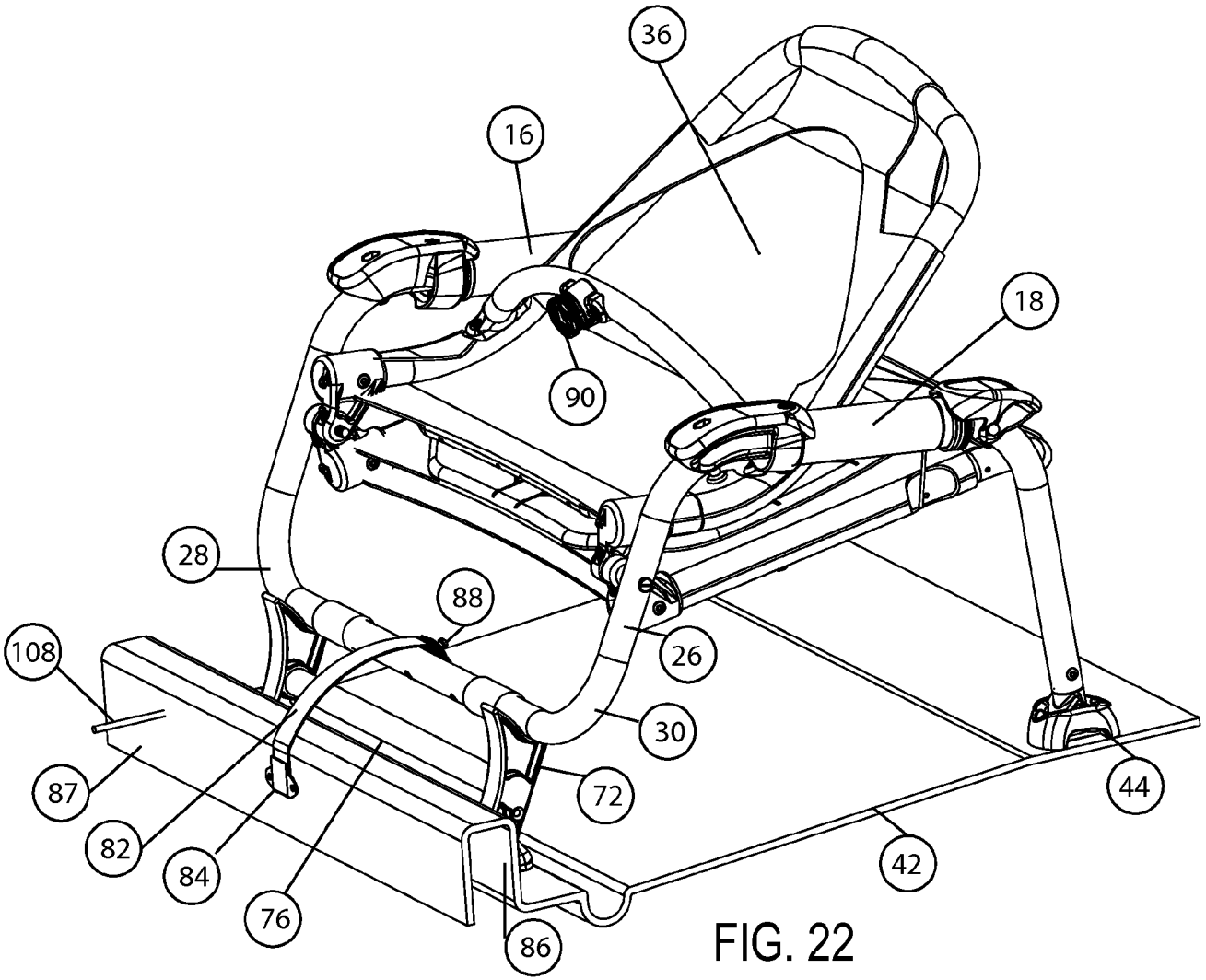
FIG. 22 is a right rear perspective view showing the lumbar support and kick stand.
Figure 23:
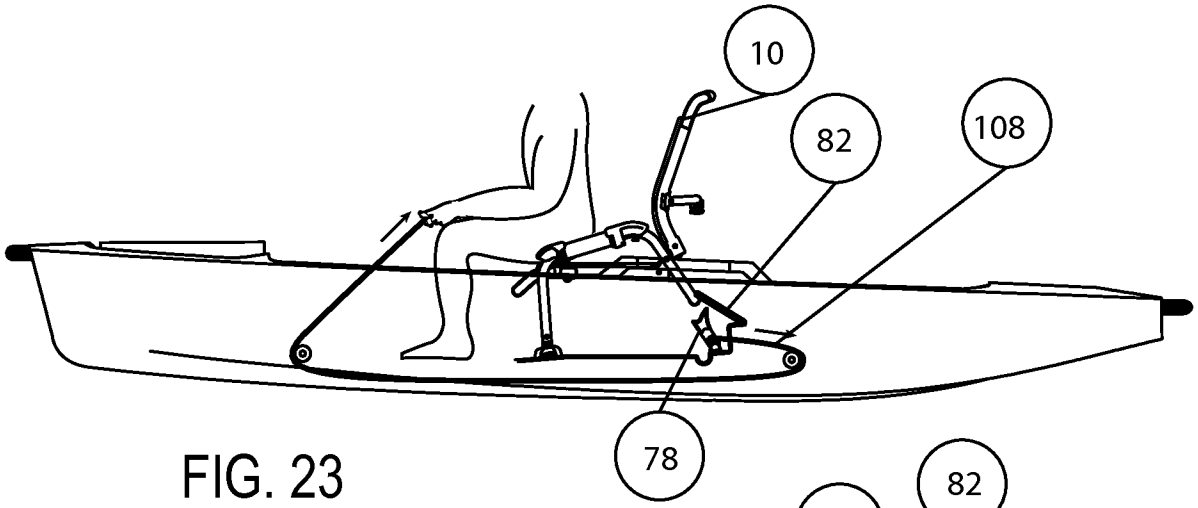
FIG. 23 is a side schematic view showing the chair with the occupant of the seat in a boat raising the chair and retracting the kick stand to allow the chair to return to the down position.
Figure 25:
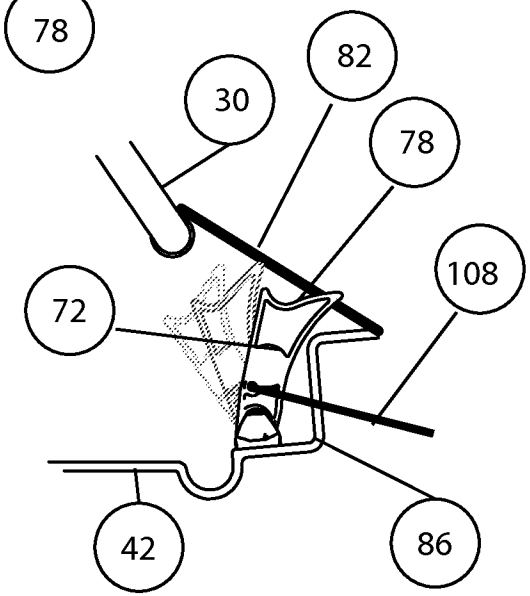
FIG. 25 shows an enlarged side view of the kick stand retracted and the chair about to be returned to the down position.
Figure 24:
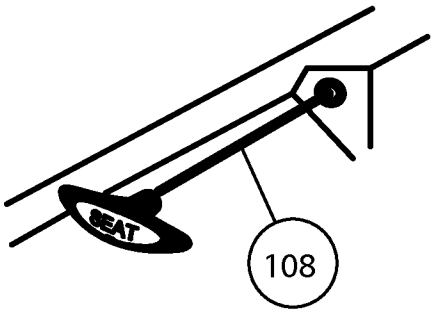
FIG. 24 shows the handgrip used by the occupant of the seat to operate the kick stand.

Turning to FIGS. 21 and 22, there is provided a lumbar support adjuster for the back support. At the rear of the chair is a tensioner member 90 which is manually operated to increase or decrease the tension in straps 92, 94, 96 and 98 as indicated by arrows in FIG. 21. In FIG. 22, the tensioner 90 is shown without the straps and shows how the tensioner is attached to the back of the seat frame.

The kick stand can also be operated by the use of a line which is simply pulled by the user. This is shown in FIGS. 11 to 13 and 23 to 25. FIG. 11 shows the down position. Chair 10 is in the lower position, resting on the surface of the kayak deck 42. Strap 82 is holding the kick stand 68 towards the back wall 86 of the kayak, away from the user. The bungee cord 80 is pulling the kick stand forwards.

Figure 12:
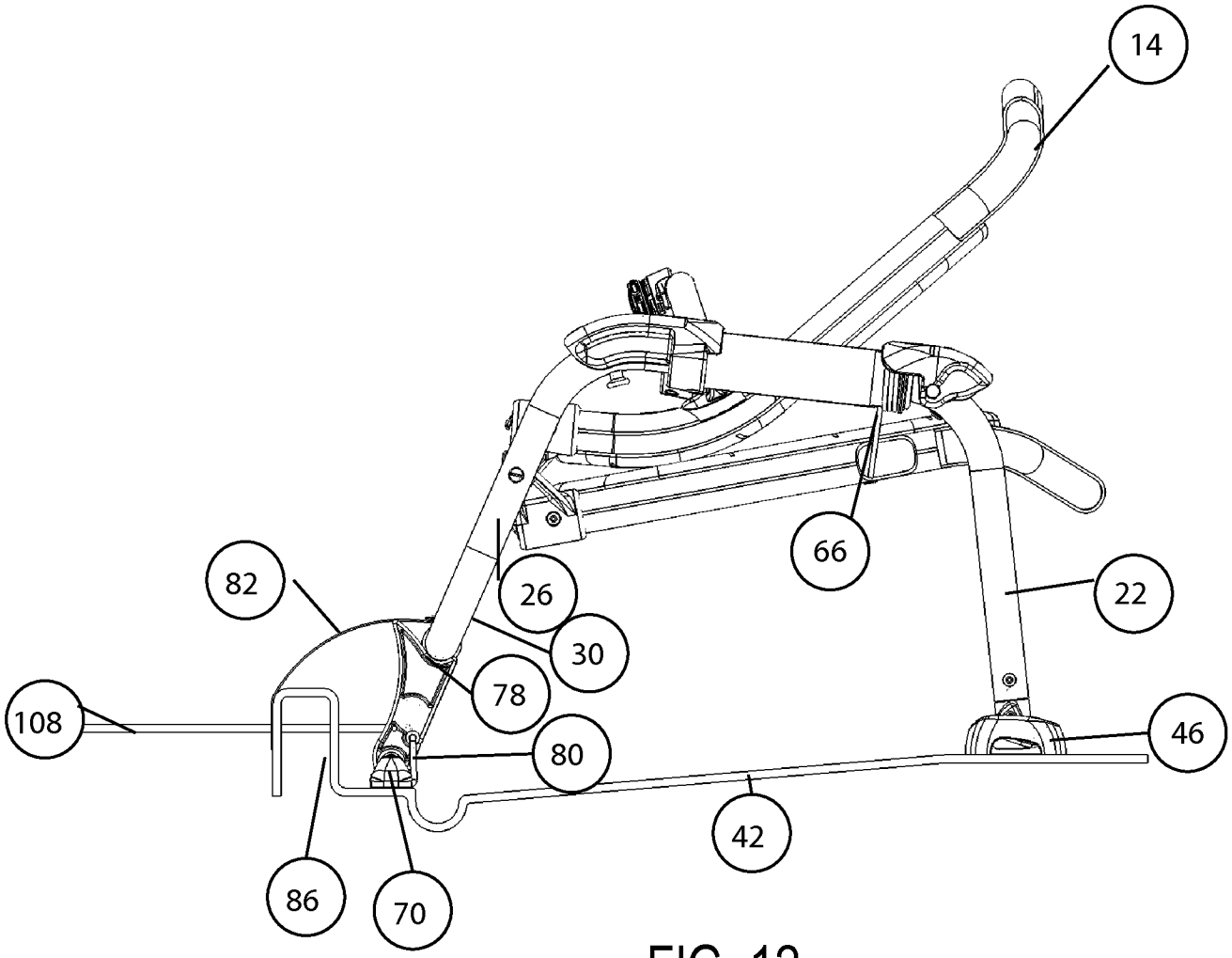

FIG. 12 shows the up position where the user has pivoted the chair up and the strap 82 has released the kick stand 68 under the tension of the bungee cord 80 to move below the chair and support the back tube 32 of the chair.

Figure 13:
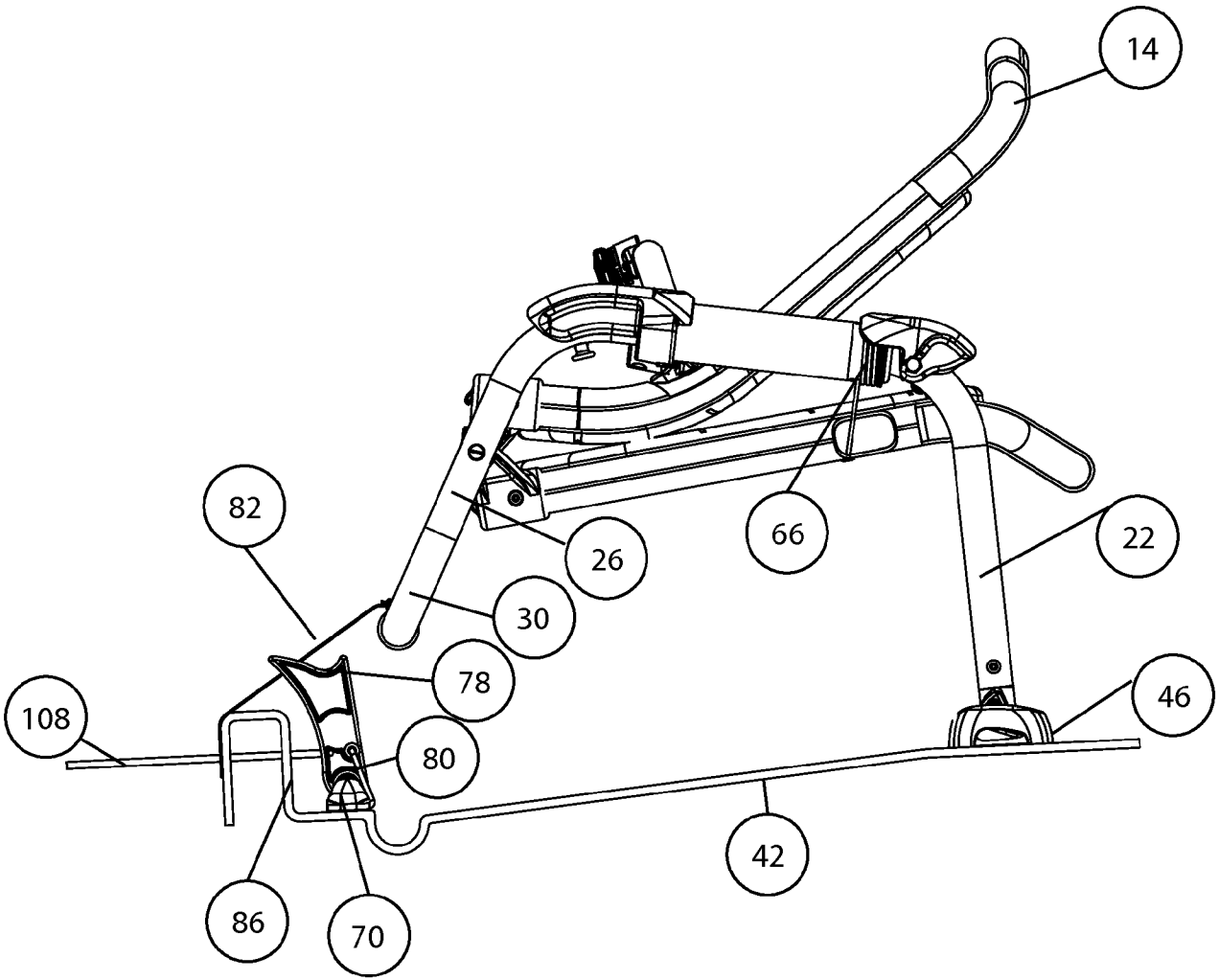
Figure 14:
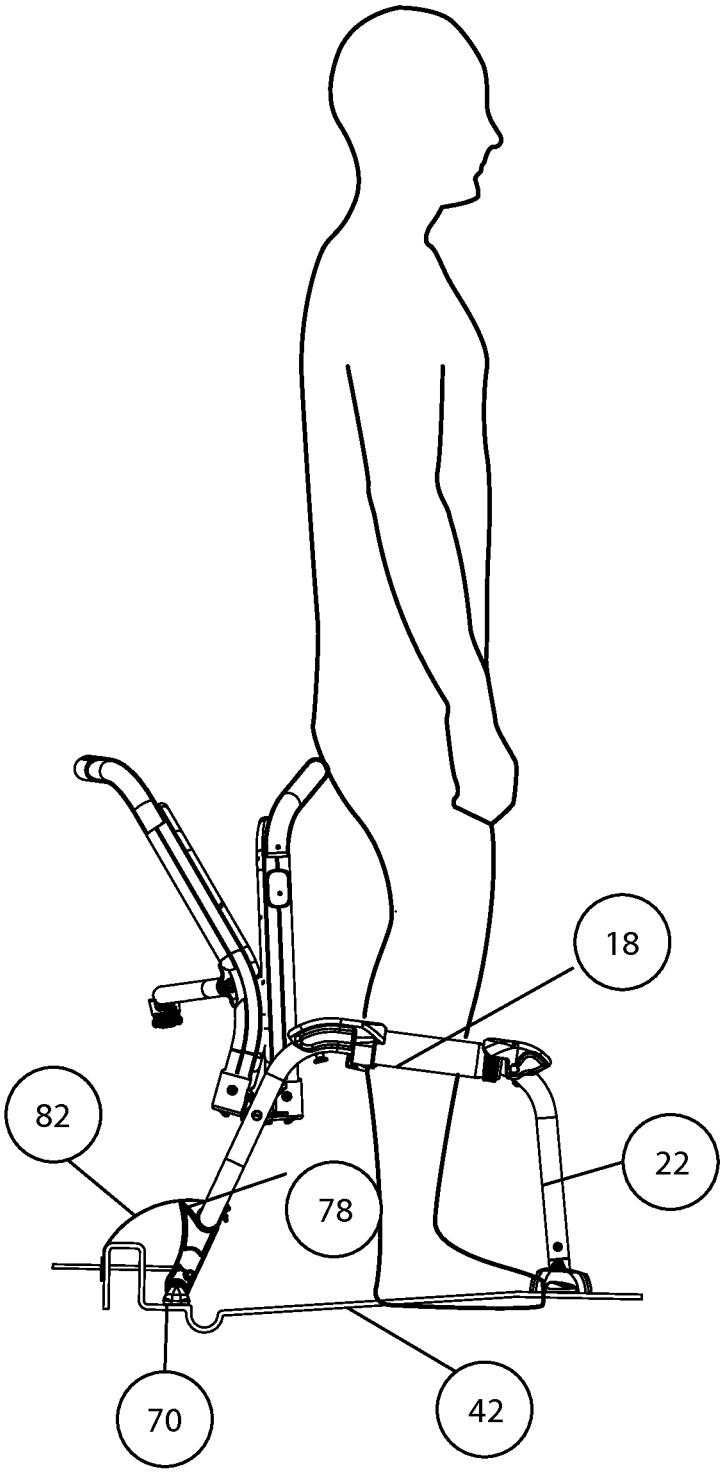
Figure 15A:
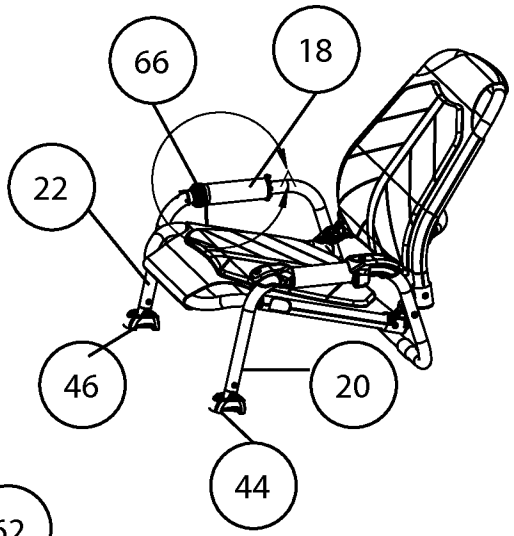
FIG. 15A shows a perspective view of the chair of FIG. 1 with the right front and rear armrest portions removed to show the mechanical adjuster for the seat bottom.
Figure 15B:
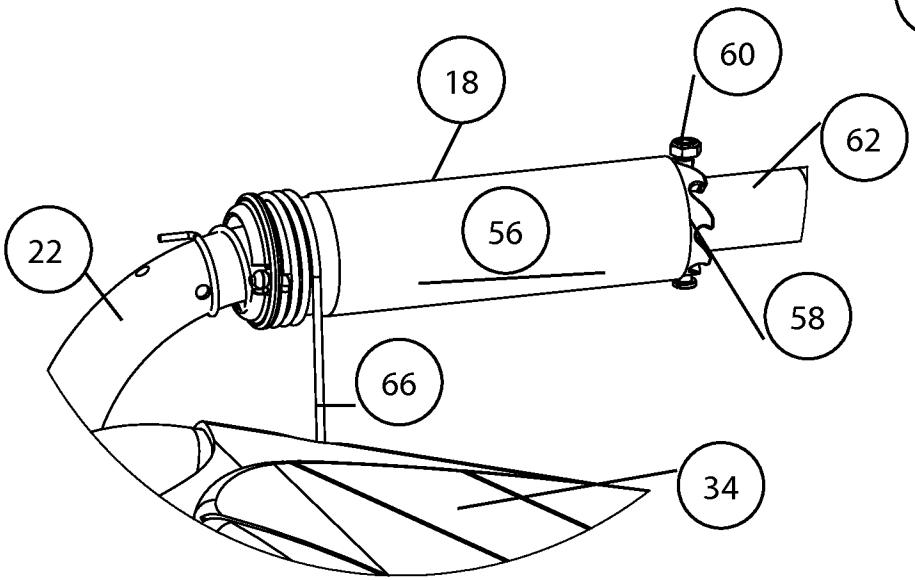
FIG. 15B is detail A in FIG. 15A, an enlarged perspective view of the mechanical adjuster on the right arm of the seat of FIG. 15A, illustrating the locking of the teeth to the pin in the tubing of the arm.
Figure 16B:
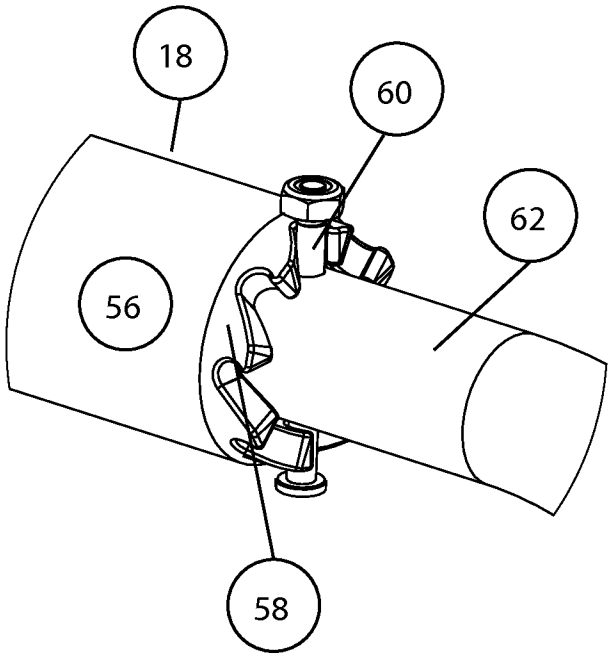
FIG. 16B is detail "A" in FIG. 16A.
Figure 16A:
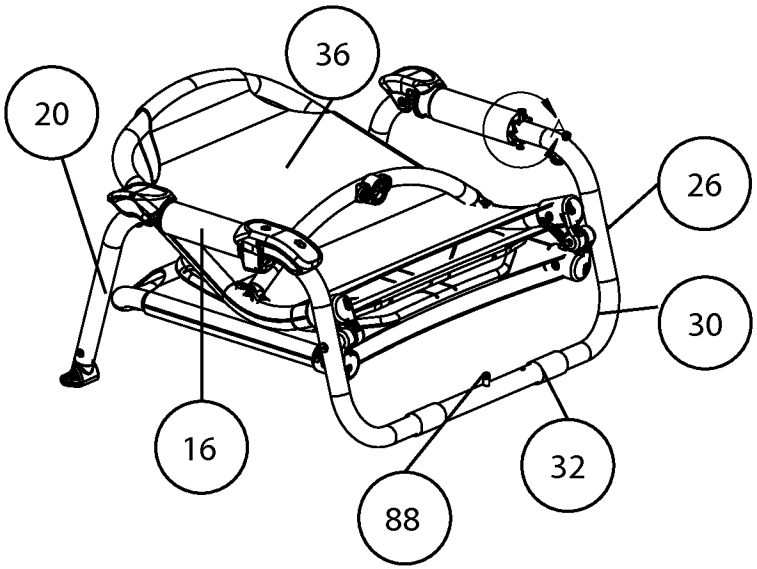
FIG. 16A is another perspective view of the chair of FIGS. 15A and 15B.
Figure 17:
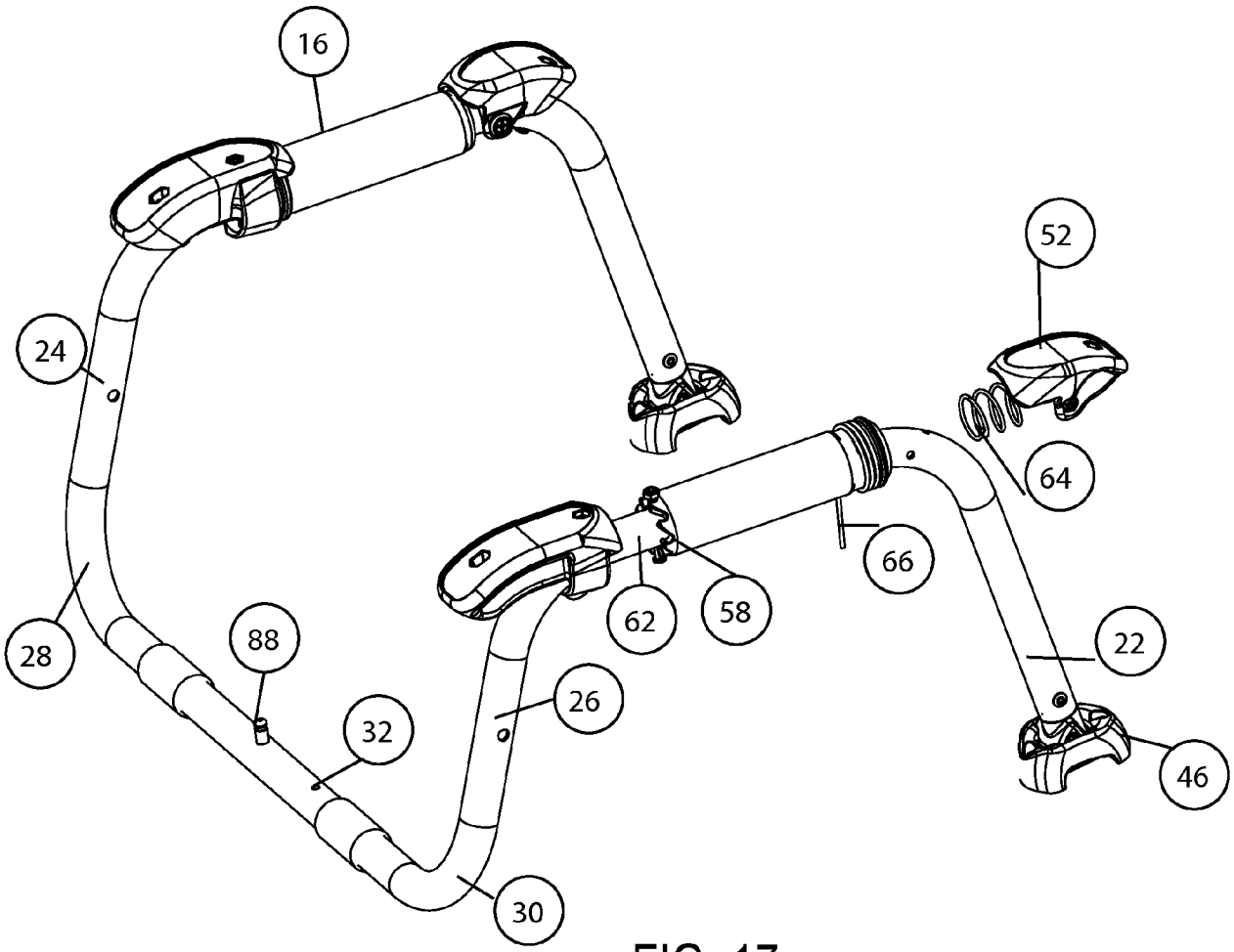
FIG. 17 is an exploded view of the right chair arm taken from the upper side and rear of the chair showing the parts of the adjuster with the seat and back being removed.
Figure 18:
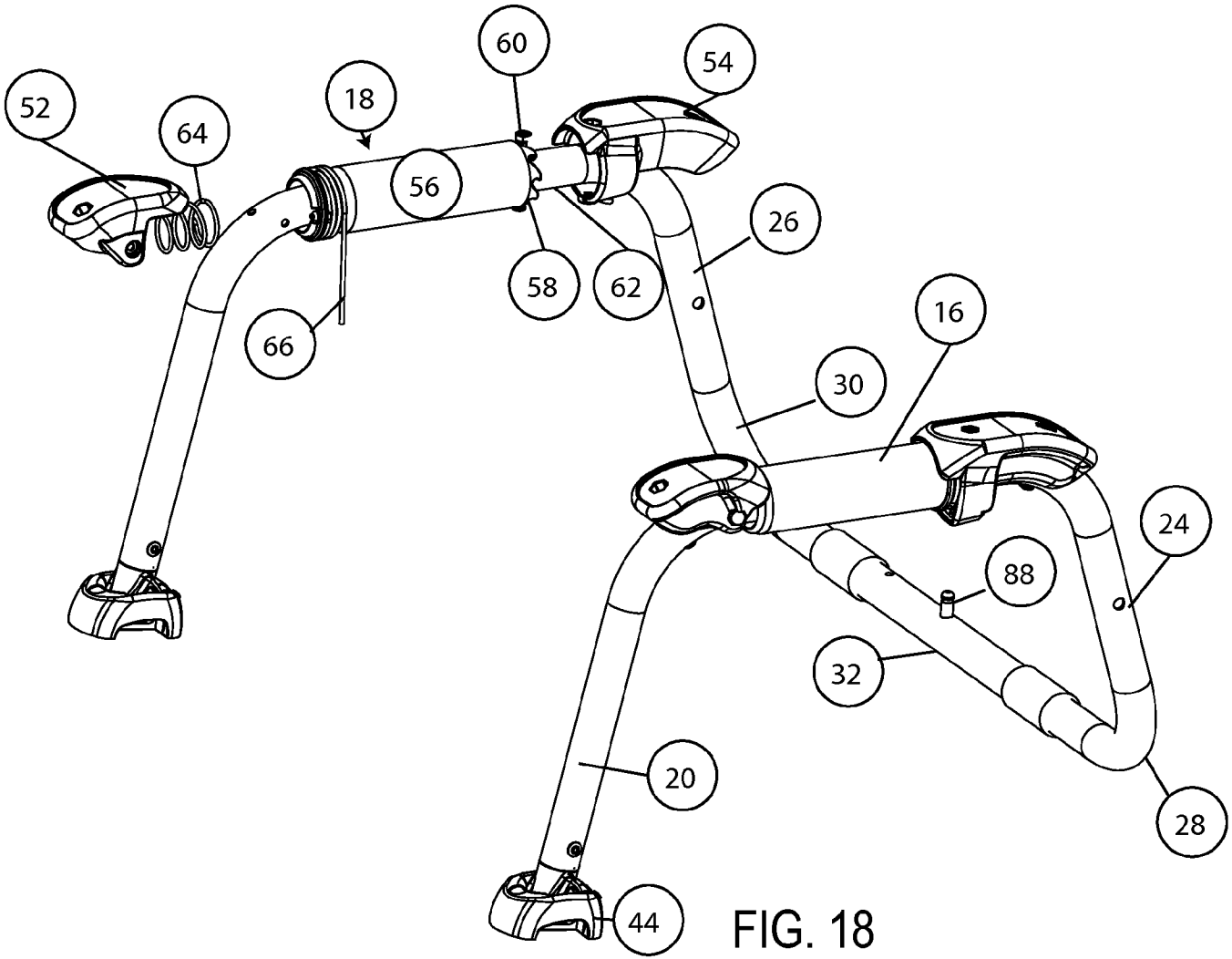
FIG. 18 is a perspective view of the parts shown in FIG. 17, taken from the upper left front side of the chair.

FIG. 13 shows the up position release where the user has pivoted the back frame 14 up further away from the kick stand 68. The user has then pulled the horizontal line 108 that can be seen on the left side of the drawing, attached to the kick stand 68, retracting the kick stand and allowing the chair to return to the down position.

What is claimed:

1. A watercraft having a chair with seat securely carried on said watercraft;

said chair having a tubular frame and comprising a seat frame, a back frame, said seat and back frames being joined via a hinged connection, arms above and at each side of the seat frame, front support legs extending downwardly from the front of each of the arms, a U-shaped rear chair support having downwardly extending portions at the rear of each of said arms, said portions joined at their lower extremity by a horizontal portion, the frames of both said seat and said back having material extending across the frame to provide a supported seating area and back support area, the lower extremity of each of the front support legs having a foot-shaped forward projection terminating in a toe, the surface of said watercraft having secured thereto two spaced apart shoes for receiving said feet, the shoes and feet being shaped such that the toe of the feet can be inserted into and removed from the shoes only when the rear of the chair is rotated upwardly and forwardly about said shoes, said feet and shoes being locked together when the chair is rotated downwardly and rearwardly.

2. The watercraft of claim 1 in combination with a kick stand, wherein the horizontal position at the rear of the chair interacts with a mechanism attached to the deck of the watercraft to allow the chair to be supported at its rear in raised position.

3. The watercraft of claim 2 wherein the kick stand is joined to the deck of the watercraft at each end of its ends, and is connected to the horizontal portion of the rear of the chair with a central flexible webbing to limit upward travel of the rear of the chair.

4. The watercraft of claim 2 wherein the kick stand has a line attached which runs to a point wherein the user while seated in the chair can cause the kick stand to raise the rear of the chair from the deck.

5. The watercraft of claim 1 wherein said supported seating area can be raised and lowered by operation of an armrest adjuster on one arm and the back support area can be forwardly and rearwardly adjusted by operation of an armrest adjuster on the other arm.

6. The watercraft of claim 1 wherein said back support has a manually adjustable lumbar support.

* * * * *